US006104894A

United States Patent [19]

Sato et al.

[11] Patent Number: 6,104,894

[45] Date of Patent: Aug. 15, 2000

[54] DEVELOPER CONTAINER

[75] Inventors: Minoru Sato; Yoshikazu Sasago, both of Toride, Japan

[73] Assignee: Canon Kabushiki Kaisha, Tokyo, Japan

[21] Appl. No.: 09/286,425

[22] Filed: Apr. 6, 1999

[30] Foreign Application Priority Data

Apr. 8, 1998 [JP] Japan ..... 10-096203

[51] Int. Cl.[7] ..... G03G 15/08

[52] U.S. Cl. ..... 399/106

[58] Field of Search ..... 399/102, 103, 399/104, 105, 106

[56] References Cited

U.S. PATENT DOCUMENTS

| | | | |
|---|---|---|---|
| 5,267,007 | 11/1993 | Watanabe et al. | 399/104 |
| 5,287,148 | 2/1994 | Sakemi et al. | 399/104 |
| 5,331,372 | 7/1994 | Tsuda et al. | 355/200 |
| 5,331,373 | 7/1994 | Nomura et al. | 355/200 |
| 5,404,198 | 4/1995 | Noda et al. | 355/200 |
| 5,452,056 | 9/1995 | Nomura et al. | 355/200 |
| 5,470,635 | 11/1995 | Shirai et al. | 428/131 |
| 5,475,470 | 12/1995 | Sasago et al. | 355/210 |
| 5,488,459 | 1/1996 | Tsuda et al. | 355/211 |
| 5,510,878 | 4/1996 | Noda et al. | 355/211 |
| 5,583,613 | 12/1996 | Kobayashi et al. | 355/200 |
| 5,585,889 | 12/1996 | Shishido et al. | 355/200 |
| 5,602,623 | 2/1997 | Nishibata et al. | 399/111 |
| 5,608,509 | 3/1997 | Shirai et al. | 399/351 |
| 5,623,328 | 4/1997 | Tsuda et al. | 399/111 |
| 5,659,847 | 8/1997 | Tsuda et al. | 399/113 |
| 5,669,042 | 9/1997 | Kobayashi et al. | 399/111 |
| 5,749,027 | 5/1998 | Ikemoto et al. | 399/113 |
| 5,774,766 | 6/1998 | Karakama et al. | 399/111 |
| 5,794,101 | 8/1998 | Watanabe et al. | 399/103 |
| 5,828,928 | 10/1998 | Sasago et al. | 399/111 |
| 5,870,654 | 2/1999 | Sato et al. | 399/109 |
| 5,878,310 | 3/1999 | Noda et al. | 399/117 |
| 5,890,036 | 3/1999 | Karakama et al. | 399/119 |
| 5,899,602 | 5/1999 | Noda et al. | 399/111 |
| 5,920,752 | 7/1999 | Karakama et al. | 399/111 |
| 5,940,658 | 8/1999 | Yokoi et al. | 399/119 |

*Primary Examiner*—Matthew S. Smith
*Assistant Examiner*—Hoang Ngo
*Attorney, Agent, or Firm*—Fitzpatrick, Cella, Harper & Scinto

[57] ABSTRACT

A developer container used in electrophotographic image forming apparatuses includes a seal member having a sealing property improved to prevent leakage of a developer. The container has a container main body to accommodate the developer, a rotary member rotating in contact with the developer, and the seal member located at an end in a direction of a rotating shaft of the rotary member to prevent the developer from leaking.

12 Claims, 12 Drawing Sheets

DEVELOPER CONTAINER

BACKGROUND OF THE INVENTION

1. Field of the Invention

The present invention relates to a developer container which is used in electrophotograph image forming apparatuses, such as laser beam printers, copying apparatuses or the like.

2. Related Background Art

When an image forming apparatus, which employs electrophotographs, is used for a long time, the apparatus requires the exchange of a photosensitive drum and the replenishment or exchange of a developer as well as the adjustment, cleaning or exchange of other members (charging device and cleaning device). Maintenance of these process means was difficult for those other than servicemen that have special knowledge.

Then, in order to solve the inconvenience described above, there has been developed a process cartridge consisting of image forming means, such as a photosensitive drum, a developing device, and a cleaning device which are integrated with one another as a cartridge.

Thereby, this process cartridge allows a user to easily carry out this maintenance and exchange by himself when the process means requires maintenance, thereby making it possible to obtain high quality images a low cost.

Such a process cartridge comprises an agitating member, for example, as a developer agitator in a vessel of a developer which is a developer container, and the agitating member is driven from the outside of a toner container by transmitting a driving force by way of a gear or the like.

A run-through hole is formed at a wall of the developer container to transmit the driving force to the agitating member, and a driving-force transmitting member passes through the hole and the agitating member in the vessel is coupled with the gear outside the container by way of the driving force transmitting member. Therefore, it is feared that the run-through hole may allow the developer to leak outside. Then, for prevention of leakage of the toner, it is conventional to dispose a seal member having a lip portion, which is in contact with an entire circumferential surface of a shaft of the driving force transmitting member.

However, there has been a desire for further improvement of a seal member.

SUMMARY OF THE INVENTION

A primary object of the present invention is to provide a developer container in which a sealing property of a seal member for preventing leakage of a developer is made more certain.

Another object of the present invention is to provide a developer container with a seal member having simple structure in which sealing property is improved.

DETAILED DESCRIPTION OF THE PREFERRED EMBODIMENTS

Now, the preferred embodiments of the developer container according to the present invention will be described specifically with reference to the accompanying drawings.

[First Embodiment]

A first embodiment will be described with reference to FIGS. 1 through 7. In this case, first, a description will be provided of an image forming apparatus and an overall configuration of a process cartridge with reference to FIGS. 4 through 7, and an explanation will be made of agitation of a developer and a seal configuration with reference to FIGS. 1 through 3.

{Image Forming Apparatus}

Figure 4:
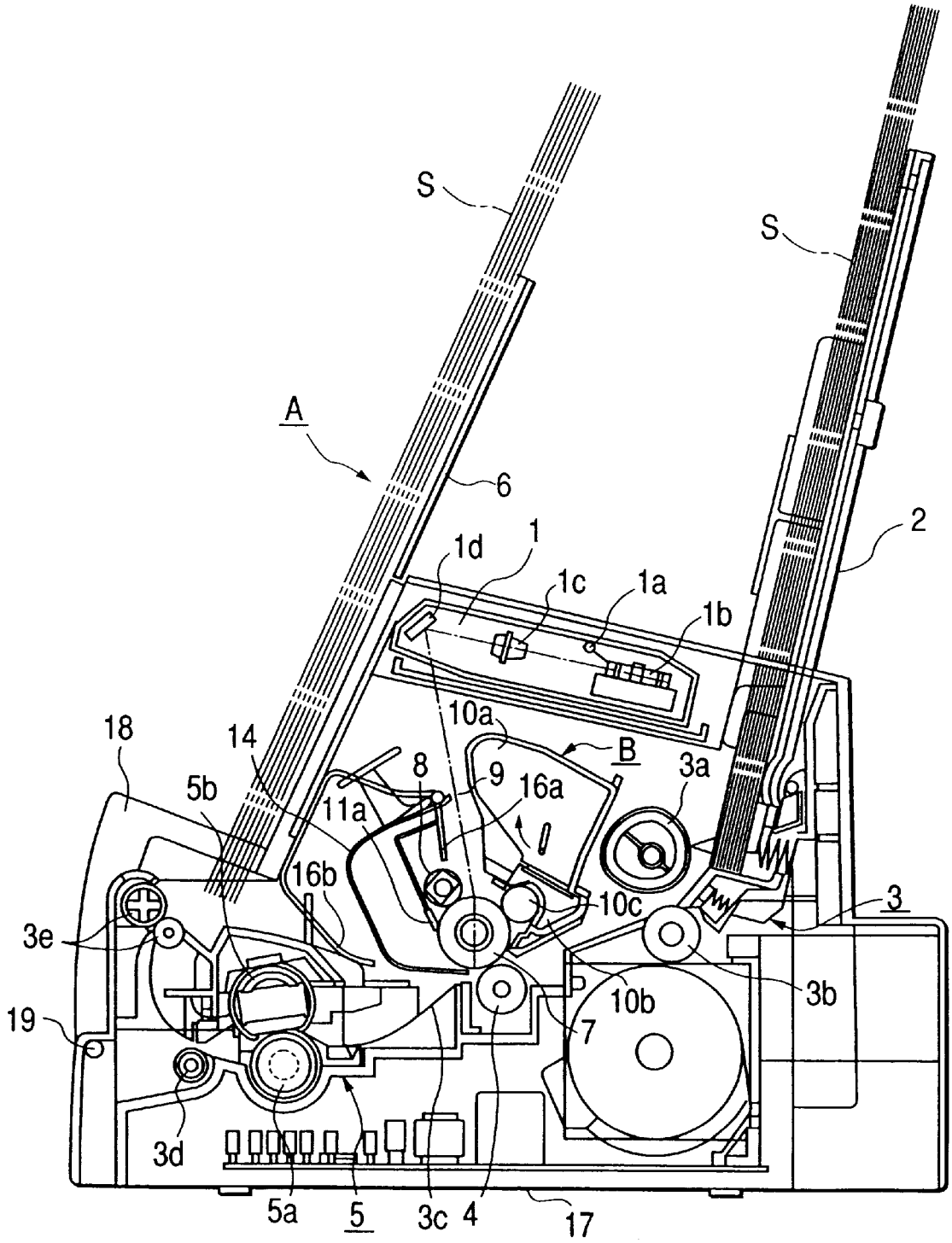
FIG. 4 is a schematic diagram illustrating an image forming apparatus as a whole in which a process cartridge is mounted.
Figure 5:
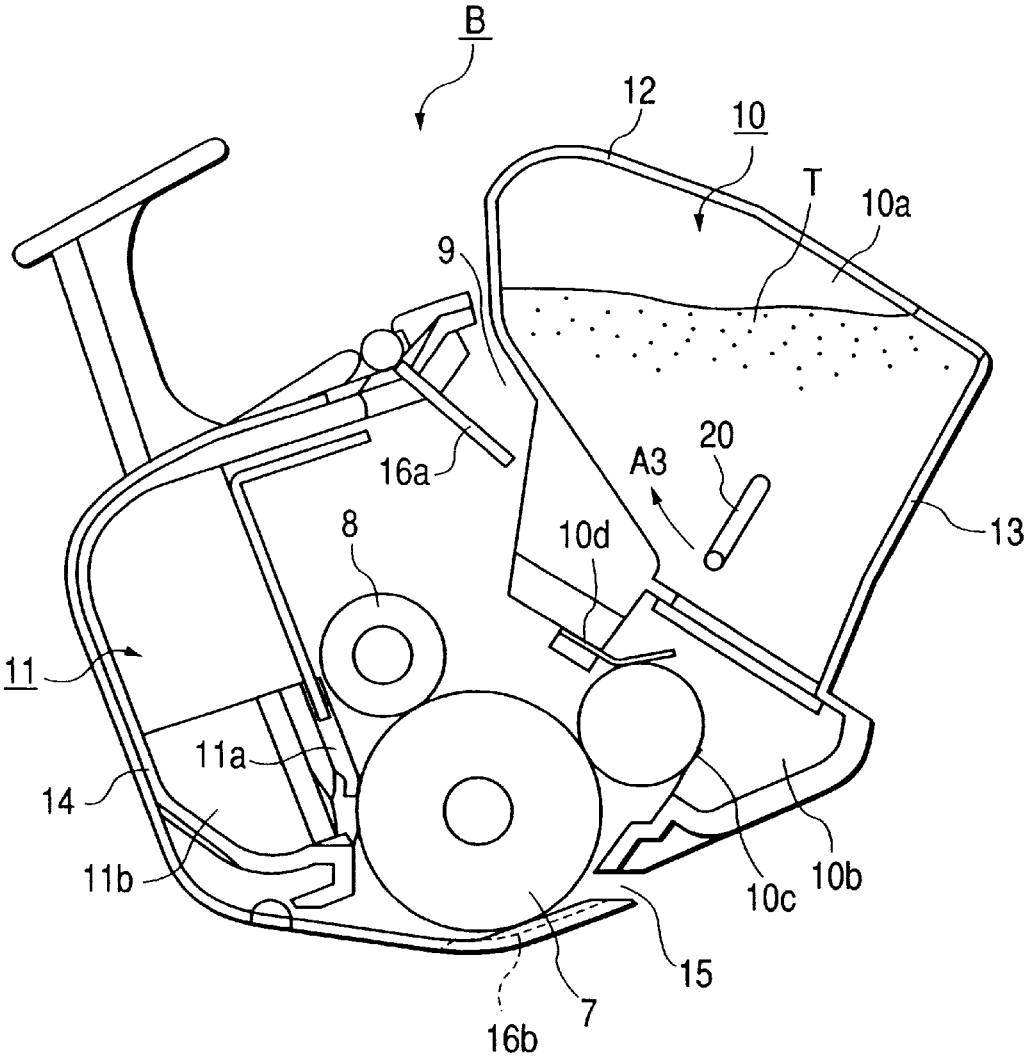
FIG. 5 is a schematic diagram illustrating a configuration of the process cartridge.
Figure 6:
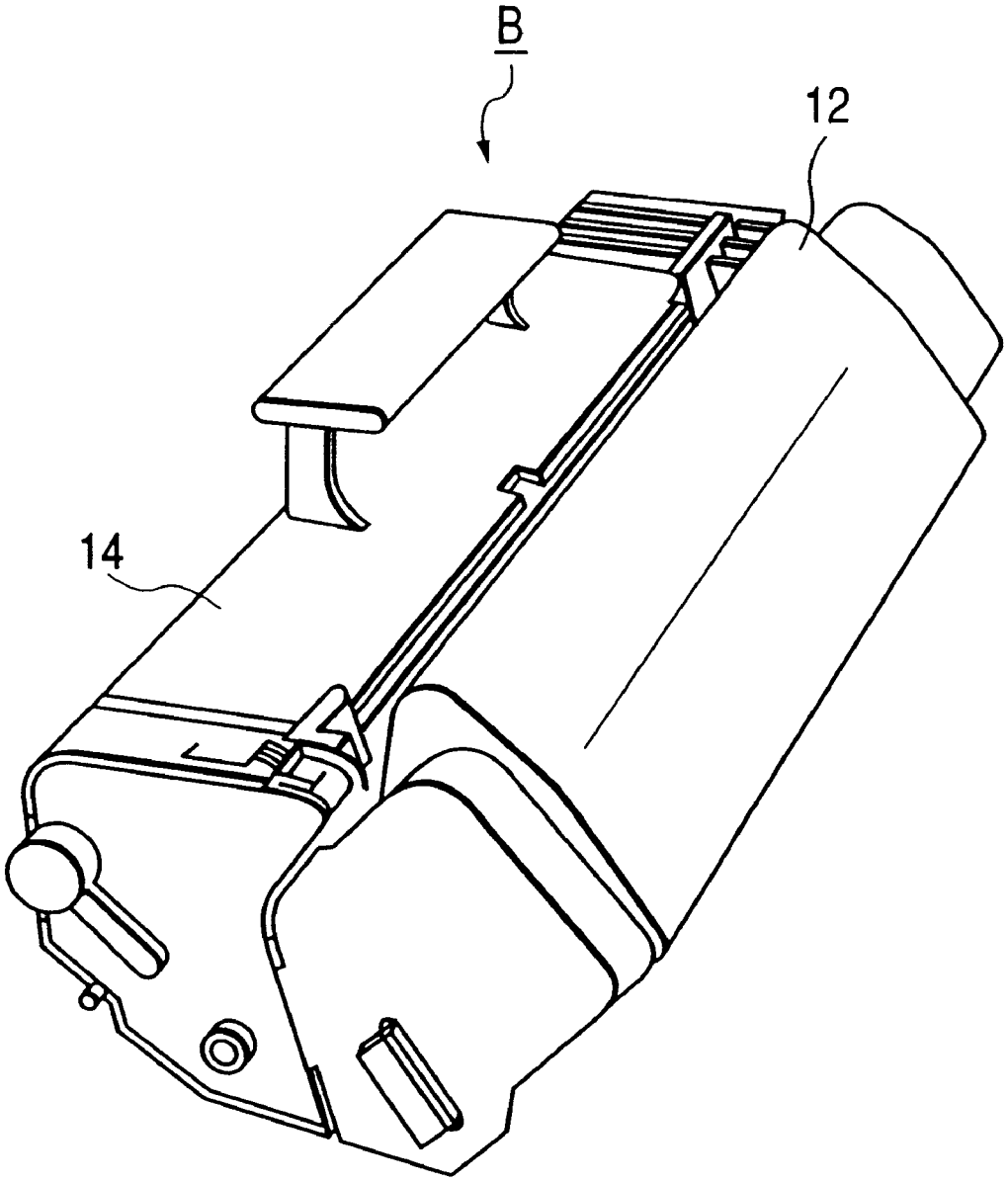
FIG. 6 is a diagram illustrating an external appearance of the process cartridge.
Figure 7:
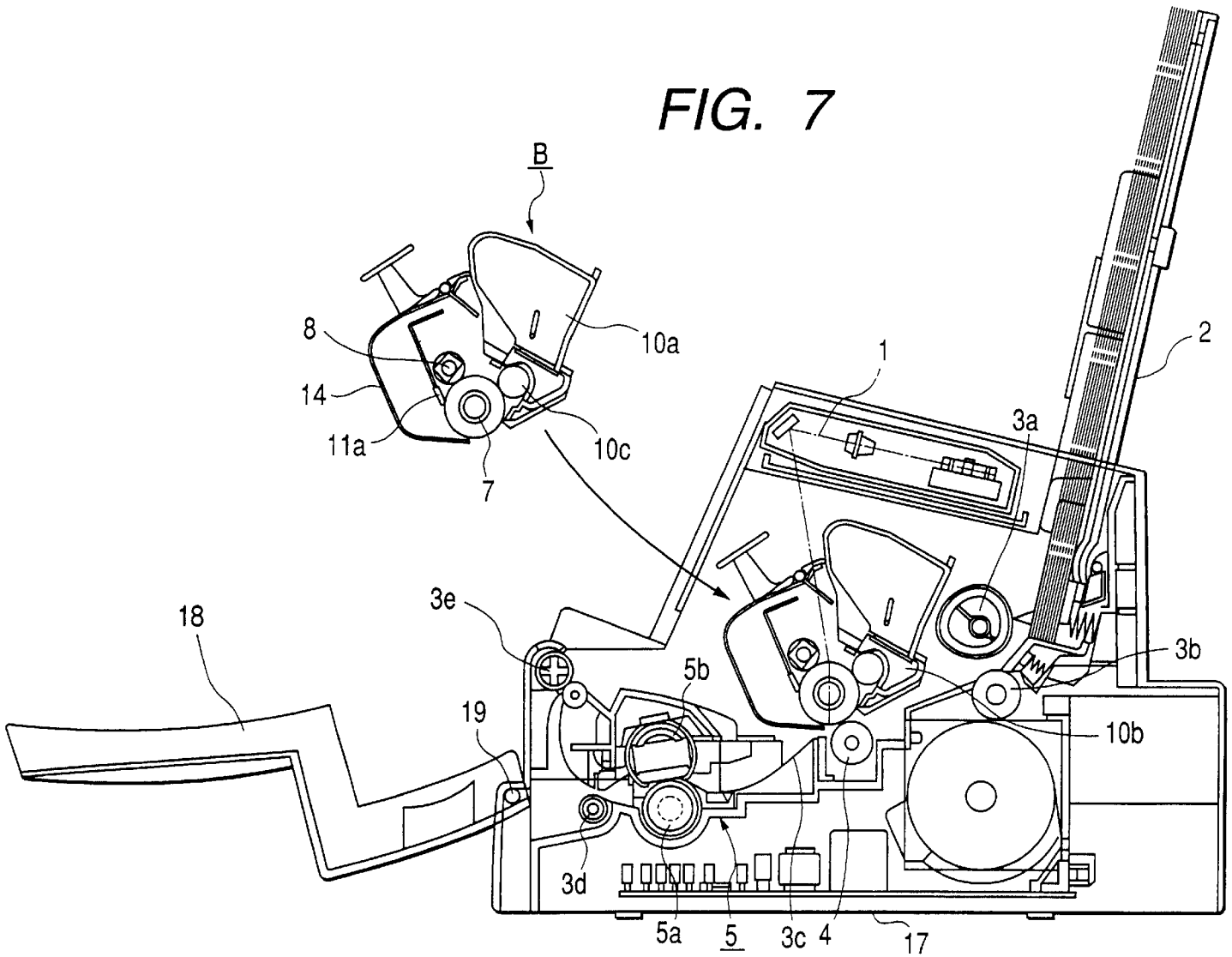
FIG. 7 is a diagram illustrating a configuration for mounting the process cartridge.

FIG. 4 is a schematic diagram illustrating an image forming apparatus as a whole in which a process cartridge is mounted, and FIG. 5 is a diagram illustrating a configuration of the process cartridge, and FIG. 6 is a diagram illustrating of an external appearance of the process cartridge, and FIG. 7 is a diagram descriptive of mounting the process cartridge.

An image forming apparatus A forms an image on a recording medium through an electrophotograph image forming process as shown in FIG. 4. It forms a latent image on a drum-like electrophotograph photosensitive body which is an image bearing member (hereinafter referred to as "photosensitive body drum") 7 by irradiating it with light from an optical system 1 and a toner image by developing the latent image with a magnetic developer (hereinafter referred to as "toner"). In synchronism with the formation of the toner image, the image forming apparatus conveys a recording medium S, which is set in a feeding tray 2, by convey means 3 comprising of a pickup roller 3*a*, a convey roller 3*b* and so on. Then, the image forming apparatus transfers the toner image formed on the photosensitive body drum 7, which is built in a process cartridge B, to the recording medium S by applying a voltage to a transfer roller 4 used as transfer means. The recording medium S to which the toner image is transferred is conveyed to fixing means 5 with a guide 3*c*. The fixing means 5 consists of a driving roller 5*a* and a fixing roller 5*b* having a built-in heater, and fixes the transferred toner image by applying heat and a pressure to the recording medium S which is passing. The recording medium S is reversed, conveyed and discharged into a discharge tray 6 with discharge rollers 3*d* and 3*e*.

{Process Cartridge}

On the other hand, the process cartridge B rotates the photosensitive body drum 7 which has a photosensitive layer as an electrophotograph sensitive body as shown in FIGS. 5 and 6, and uniformly charges a surface of the photosensitive body drum 7 by applying a voltage from a charging roller 8 used as charging means. Then, the process cartridge B forms an electrostatic latent image by irradiating the photosensitive body drum 7 with a laser beam corresponding to image data from the optical system 1 through an exposure aperture 9 and develops the image by developing means 10 by using the toner. That is, the charging roller 8 is disposed in contact with the photosensitive body drum 7 and charges the photosensitive body drum 7. The developing means 10 develops the latent image formed on the photosensitive body drum 7 by supplying the toner to a developing region of the photosensitive body drum 7. The optical system 1 comprises a laser diode 1*a*, a polygonal mirror 1*b*, a lens 1*c* and a reflecting mirror 1*d* as shown in FIG. 4.

As shown in FIG. 5, the developing means 10 comprises a toner chamber 10*a* used as a developer container and a developing chamber 10*b*, and supplies to the developing chamber 10*b* the toner agitated with an agitating rod 20, which is provided as a driving rotary member for carrying or agitating the toner in the toner chamber 10*a*, and rotates a developing roller 10*c* disposed in the developing chamber 10*b*, and forms a toner layer which is charged by friction with a developing blade 10*d* on a surface of the developing roller 10*c* having a built-in fixed magnet, and supplies the toner to the developing region of the photosensitive body drum 7. The developing means 10 transfers the toner to the photosensitive body drum 7 in correspondence to the latent image, thereby forming a toner image to visualize the latent image.

After the toner image formed on the photosensitive body drum 7 is transferred to the recording medium S by applying to a transferring roller 4 a voltage having a polarity reverse to that of the toner image, cleaning means 11 removes residual toner from the photosensitive body drum 7. The cleaning means 11 scrapes off the residual toner from the photosensitive body drum 7 with a cleaning blade 11*a* and collects the residual toner into a waste toner container 11*b*.

The parts such as the photosensitive body drum 7 are accommodated in a cartridge frame body which is configured by coupling a toner developing frame body 12, a toner developing wall member 13, and a cleaning frame body 14 so as to form a cartridge. That is, the toner developing frame body 12 is soldered to the toner developing wall member 13 to configure the toner chamber 10*a* as a developer container and the developing chamber 10*b*, and the developing roller 10*c* and the developing blade 10*d* are attached to the developing chamber 10*b*. Members which configure the photosensitive body drum 7, the charging roller 8, and the cleaning means 11 are attached to the cleaning frame body 14 as the developer container. The process cartridge B is configured by coupling the toner developing frame body 12 with the cleaning frame body 14 so that they can swing.

Formed in the process cartridge B are an exposure aperture 9 which is to be used for irradiating the photosensitive body drum 7 with light corresponding to image data and a transfer aperture 15 which serves for opposing the photosensitive body drum 7 to the recording medium S. There are disposed shutter members 16*a* and 16*b* which can open and close both the apertures 9 and 15. That is, the transfer aperture 15 is formed to transfer the toner image formed on the photosensitive body drum 7 to the recording medium S. The image forming apparatus A is disposed so that an open/close cover 18 is rotatable relative to a main body 17 of the apparatus and around a shaft 19, as shown in FIG. 7. When the open/close cover 18 is opened, a mounting space of the process cartridge B comes into sight. A guide member (not shown) which guides the process cartridge B is disposed in the mounting space of the process cartridge B. An operator mounts and dismounts the process cartridge B along the guide member.

{Agitating Structure}

Figure 1:
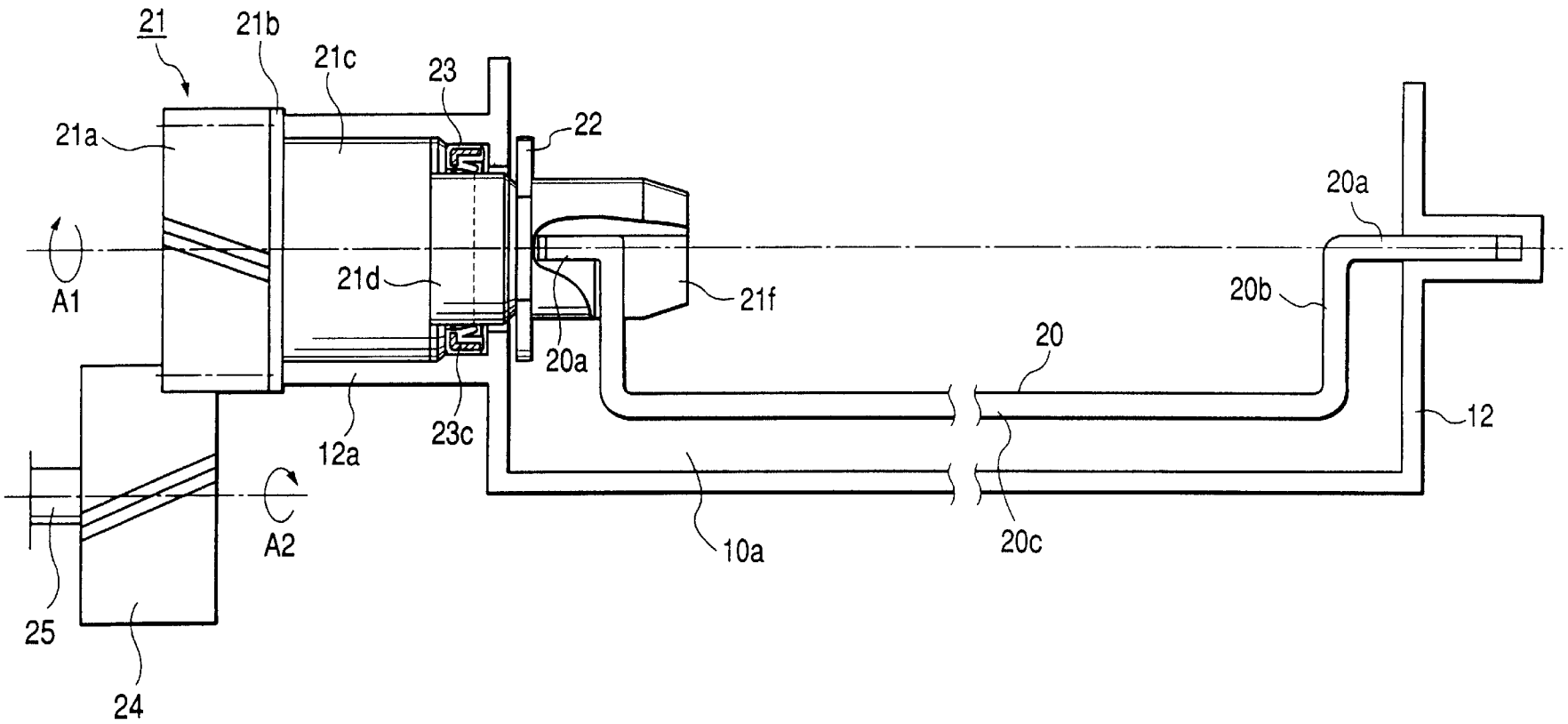
FIG. 1 is a diagram illustrating a developer agitating configuration in a developing frame body.
Figure 2:
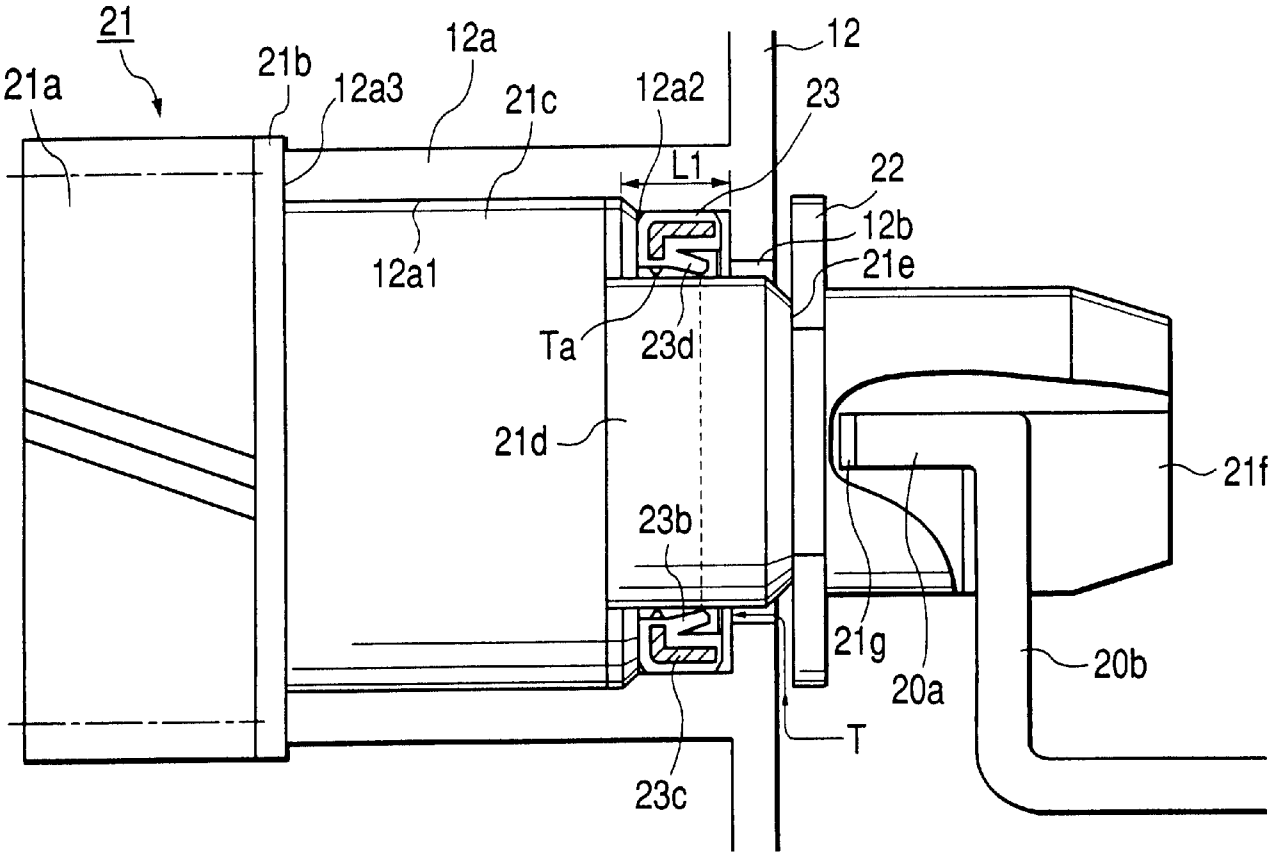
FIG. 2 is a diagram illustrating a seal configuration.
Figure 3:
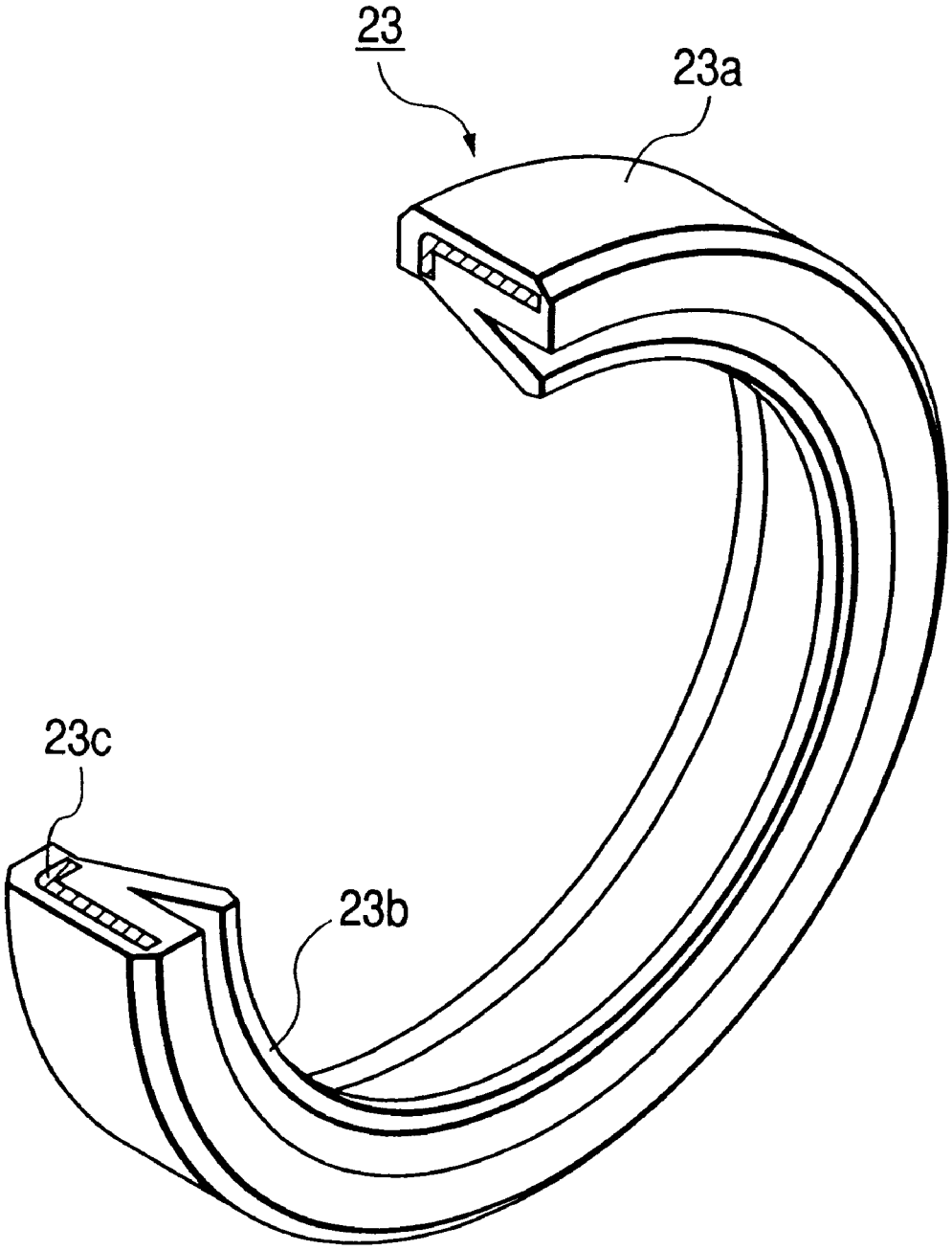
FIG. 3 is a partial sectional view illustrating the seal member.

Now, a description will be provided of a toner agitating configuration in the toner chamber 10*a* and its seal portion with reference to FIGS. 1 through 3. FIG. 1 is a diagram descriptive of a developer agitating configuration in the developing frame body, and FIG. 2 is a diagram descriptive of a seal configuration and FIG. 3 is a partial sectional view of a seal member.

As shown in FIG. 1, an agitating rod 20, which is a rotary member, is a crank-like member which has an end supported by an agitating gear 21 so as not to rotate and another end supported by the toner developing frame body 12 so as to be rotatable. The agitating rod 20 is an integral linear member which is configured by coupling tips of arm portions 20*b* which protrude in a radial direction from journals 20*a* at both ends with a pin portion 20*c* and integrated with an agitating gear 21 which is a rotary member so as to be rotatable in the toner charged in the toner chamber 10*a*.

The agitating gear 21, which is a driving force transmitting rotary member, has a helical gear portion 21*a*, a protruding portion 21*b*, a supported portion 21*c*, a seal portion 21*d*, a groove portion 21*e* and a tip notch portion 21*f*, as shown in FIG. 2. The tip notch portion 21*f* passes through a center of an end surface of the agitating gear 21, and a hole 21*g* into which the journal portion 20*a* of the agitating rod 20 is to be fitted is formed at the center of the end surface, and the arm portion 20*b* of the agitating rod 20 is fitted into the tip notch portion 21*f*.

The supported portion 21*c* is rotatably supported with an inside surface 12*a*1 of a cylindrical protruding portion 12*a* of the toner developing frame body 12 as shown in FIG. 2.

The groove portion 21*e* and the tip notch portion 21*f* are disposed in the toner chamber 10*a*. The agitating rod 20 is fitted in the tip notch portion 21*f*, and a stopper ring 22 for an E-shaped shaft is disposed in the groove portion 21*e* at a location where it is slightly movable in a thrust direction even after the agitating gear 21 is set in position so that the agitating gear 21 cannot come out of the developing frame body 12 leftward (outward) in FIGS. 1 and 2 after assembly.

{Seal Configuration}

In order to prevent the toner T from leaking out of the toner chamber 10*a*, a seal member 23 equipped with an elastic body of nitrile rubber or the like is inserted along the inside wall 12*a*1 of the cylindrical protruding portion 12*a* of the toner developing frame body 12 and is fixed by pressing an outer circumferential surface 23*a* of the seal member 23 into a seal fitting hole 12*a*2 which has a diameter smaller than that of the inside surface 12*a*1. A lip portion 23*b* which is a contact portion to be in contact with an entire circumferential surface of the seal portion 21*b* of the agitating gear 21 is disposed on the seal member 23 as shown in FIG. 3. The seal portion 21*d*, the groove portion 21*e*, and the tip notch portion 21*f* of the agitating gear 21 pass through the seal member 23 to bring the lip portion 23*b* into contact with the seal portion 21*d*, thereby preventing the toner T from penetrating.

As for a fitting amount between the lip portion 23*b* and seal portion 21*d*, it is adequate to enlarge a diameter of the lip portion 23*b* 0.4 to 1.0 mm by fitting the lip portion 23*b* into the seal portion 21*d*. The helical gear portion 21*a* and the protruding portion 21*b* are outside the toner chamber 10*a*, and a driving force is transmitted to the helical gear portion 21*a* from a driving helical gear 24 which is in mesh therewith.

The driving helical gear 24 is rotatably supported by a shaft disposed in the toner developing frame body 12. And the driving helical gear 24 has a leftward helix direction and is rotated clockwise as seen from outside the toner chamber 10*a* (indicated by an arrow A2 in FIG. 1), whereas the helical gear portion 21*a* of the agitating gear 21 has a rightward helix direction and is rotated counterclockwise (indicated by an arrow A1 in FIG. 1). Furthermore, a stopper 25 is disposed in the toner developing frame body 12 to restrict leftward (outward) movement of the driving helical gear 24 which is in mesh with the helical gear portion 21*a*.

When a driving force is transmitted from the driving helical gear 24 to the helical gear portion 21*a* of the agitating gear 21 by way of a gear train in the relationship described above, helical gears produce thrust forces: In FIG. 1, the driving helical gear 24 produces a leftward thrust force and the agitating gear 21 produces a rightward thrust force to press the agitating gear 21 into the toner chamber 10*a*. When the driving helical gear 24 is not in contact with the stopper 25 at this time, the gear moves until it comes into contact with the stopper. When the protruding portion 21*b* is not in contact with a stopper 12*a*3 of the cylindrical protruding portion 12*a* of the toner developing frame body 12, the agitating gear 21 similarly moves until the protruding portion 21*b* comes into contact with the stopper 12*a*3, and then stops. The seal is configured to reserve a space in which the seal member 23 is not compressed toward a center axis of the agitating gear 21 even in such a condition as shown in FIG. 1.

That is, when a length as measured from a bottom of the seal fitting hole 12*a*2 (on a side closer to the toner chamber 10*a*) to a step between the supported portion 21*c* and the seal portion 21*b* is represented by L1, and a height of the seal member 23 is designated by L2 the seal member 23 being in contact with the bottom of the seal fitting hole 12*a*2, L1 is larger than L2. The stopper ring 22 for the E-shaped shaft which is built in the groove portion 21*e* is always in a condition floated from (not in contact with) a wall surface of the toner developing frame body 12 when the protruding portion 21*b* is in contact with the stopper 12*a*3 of the cylindrical protruding portion 12*a* of the toner developing frame body 12 and in this condition, the agitating gear 21 rotates integrally with the agitating rod 20 in a direction indicated by an arrow A3 in FIG. 5 to agitate the toner T.

The seal member 23 used in the first embodiment is magnetized by inserting a magnetic metal plate 23*c* which is L-shaped on a section in parallel with the axial line of the agitating gear 21 and made of SPCC, SECC or the like into an elastic material such as nitrile rubber and shaping the metal plate. The agitating gear 21 is prepared by molding a material such as polycarbonate (PC) which contains polyacetal (POM) and fluorine, for example, to improve a sliding property. The metal plate 23*c* which is L-shaped has strength in the axial direction and a direction perpendicular thereto.

Speaking of a behavior of a magnetic toner T in the vicinity of the seal member 23 in the seal configuration described above as shown in FIG. 2, the magnetic toner T comes close to the seal member 23 from the toner chamber 10*a* through a toner chamber run-through hole 12*b* which is formed to allow agitating gear 21 to go into the frame body. In the vicinity of the seal member 23, a portion of the magnetic toner T is attracted by a magnetic force to the magnetic metal plate 23*c* which is magnetized in the seal member 23 and another portion comes close to the elastic lip portion 23*b*. At this stage, the magnetic toner T may pass through the lip portion 23*b* when a slight sink is formed at a molding stage on the seal portion 21*d* which is the surface of the agitating gear 21 brought into contact with the lip or the lip portion 23*b* is slightly lacked.

In the vicinity of the magnetic metal plate 23*c* which is magnetized in the seal member 23, however, a magnetic toner Ta which has passed through the lip portion 23*b* as described above is attracted by the magnetic force of the magnetic metal plate 23*c* and collected to a surface of the seal member 23. As a result, the seal configuration is capable of preventing the magnetic toner T from leaking to the inside surface 12*a*1 of the cylindrical protruding portion 12*a* which is disposed between the agitating gear 21 and the toner developing frame body 12. The metal plate 23*c* may be covered with the elastic portion of the seal member 23 or may be exposed without being covered so far as it is not in contact with the seal portion 21*b*.

[Second Embodiment]

Figure 8:
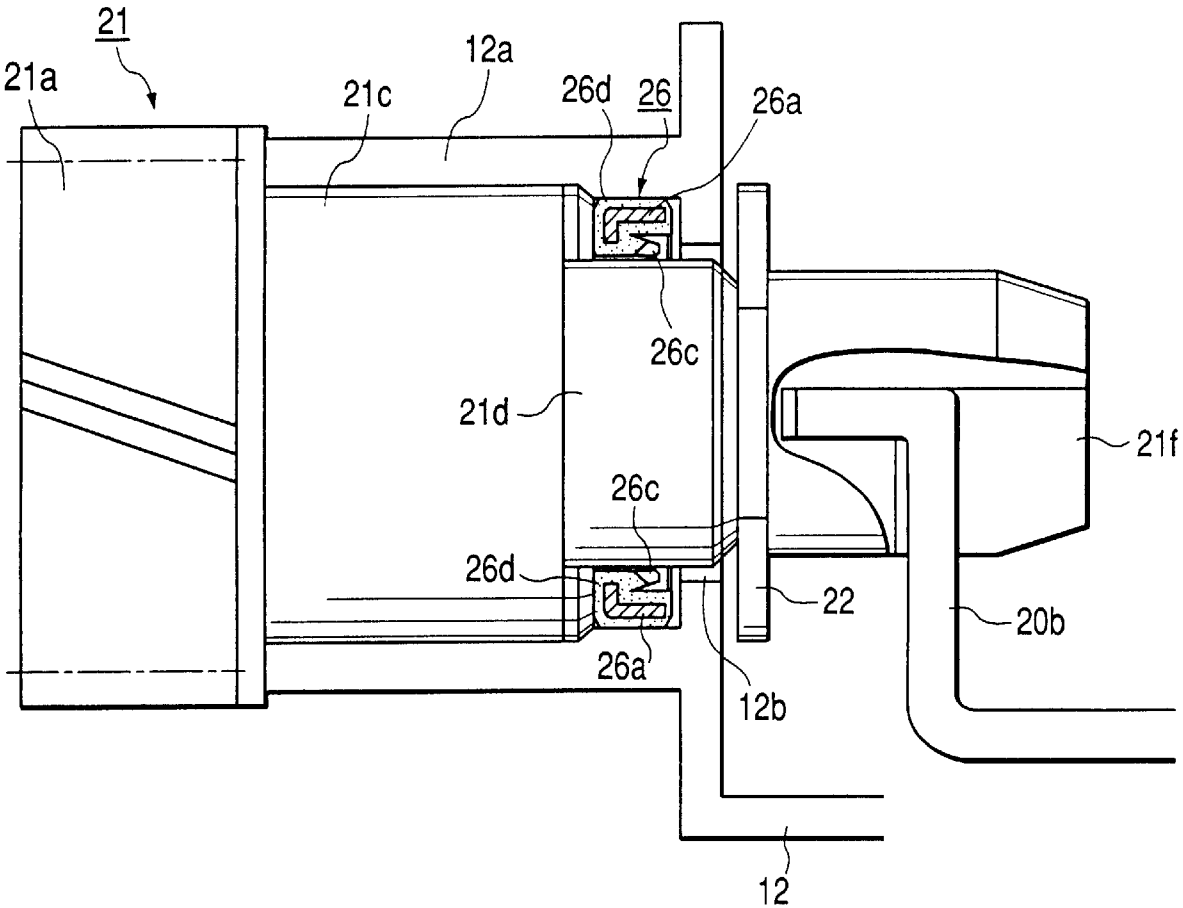
FIG. 8 is a diagram illustrating a seal configuration in a second embodiment.

FIG. 8 shows a seal configuration in a second embodiment. Members of the second embodiment are the same as those of the first embodiment described above, except for a seal member 26 which is adopted for the second embodiment.

In the second embodiment, the seal member 26 is prepared by inserting a magnetic metal plate 26*a* made of SPCC, SECC or the like into an elastic body having a lip portion 26*b* and magnetizing the metal plate 26*a*, and a lip tip 26*c* is made of an elastic material such as nitrile rubber and another portion 26*d* is made of an elastic material such as nitrile rubber mixed with a magnetic material (powder) which are combined by two-color molding or the like. The magnetic material is magnetized after molding (or at the same time as a molding stage). In the second embodiment which uses the seal member 26, not only the magnetic metal plate 26*a* can provide in the vicinity of the seal member 26 a behavior of the magnetic toner T which is the same as that in the first embodiment, but also the seal member 26, which contains the mixed magnetic material, is capable of preventing leakage of the magnetic toner T more securely.

[Third Embodiment]

Figure 9:
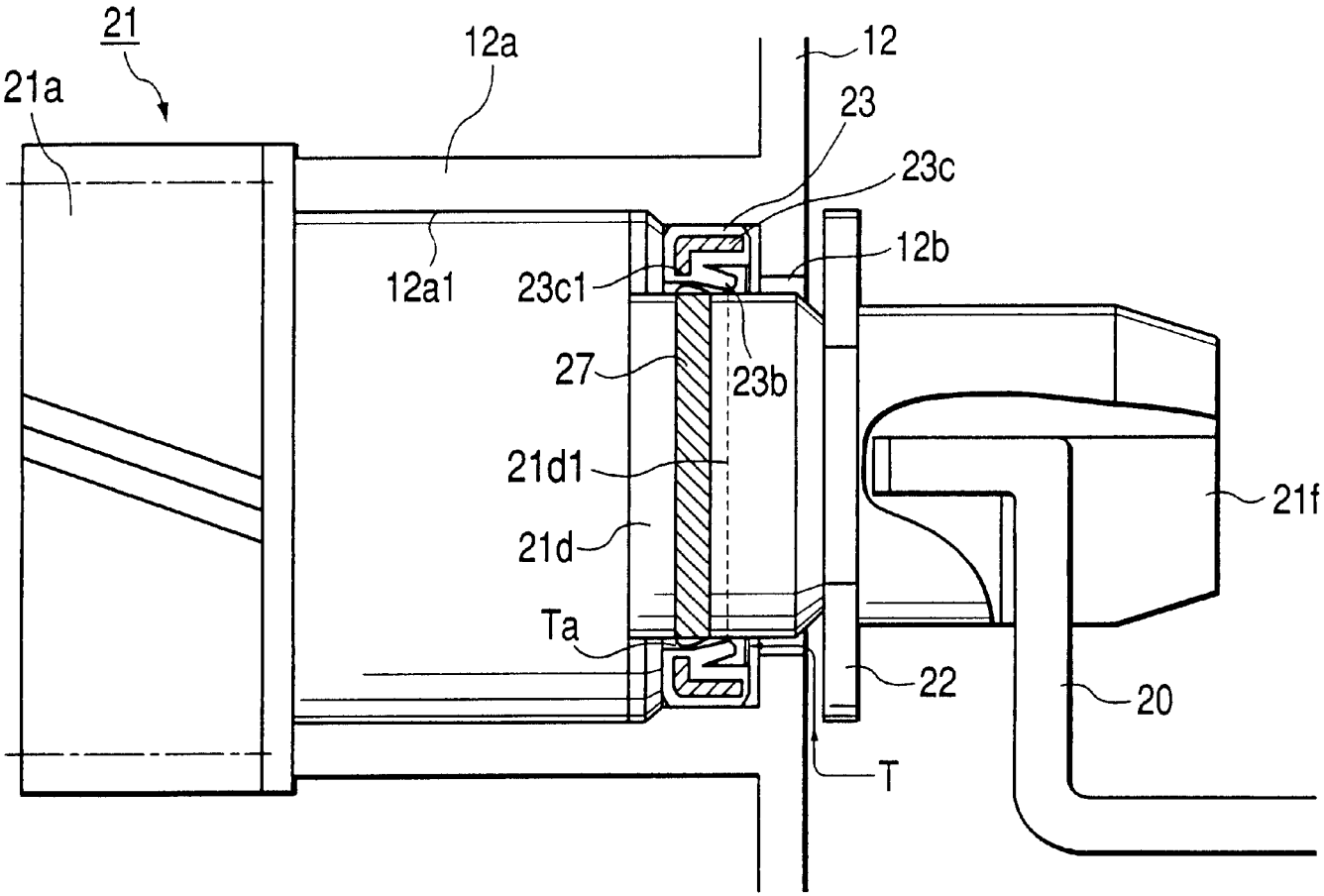
FIG. 9 is a diagram illustrating the seal configuration in a third embodiment.

Now, a description will be provided of a seal configuration in a third embodiment of the developer container according to the present invention with reference to FIG. 9. The third embodiment is the same as the first embodiment described above, except for the seal configuration.

A seal member shown in FIG. 9 is the same as that described with reference to the first embodiment. That is, the seal member is configured by inserting a magnetic metal plate 23*c*, which is made of SECC, SPCC or the like and has an L-shaped section, into an elastic material, such as nitrile rubber, so that a bent shorter side 23*c*1 of the metal plate is located outside a lip portion 23*b* and on a side of a shaft.

On the other hand, a slide portion 21*d*1 (lip portion) of a seal portion 21*d* of an agitating gear 21 is made of a material such as polycarbonate (PC) which contains polyacetal (POM) and fluoride to improve a sliding property, and a magnetic member 27 (magnetic metal, plastic magnet or the like) which is magnetized (or to be magnetized at or after a shaping stage) is inserted and shaped at a location nearly the same as that of the L-shaped bent shorter side 23*c*1 of the magnetic metal plate 23*c* in the seal member which is outside the sliding portion 21*d*1 so as to oppose to the shorter side 23*c*1.

Speaking of a behavior of the magnetic toner T in the configuration described above, the magnetic toner T comes close to a seal member 23 from the toner chamber 10*a* through the toner chamber run-through hole 12*b*. At this time, the magnetic toner T may pass through the lip portion when a slight sink was formed at a molding stage of the lip sliding portion 21*d*1 of the agitating gear 21 or the lip portion 23*b* is slightly lacked.

However, a toner Ta that has passed through the lip portion can be collected by magnetic lines of force of the magnetic metal plate 23*c* in the seal member 23 and the magnetic member 27 on the side of the shaft as described above. Accordingly, the seal configuration is capable of preventing the magnetic toner T from leaking to the inside surface of the cylindrical protruding portion 12*a*1, which is disposed between the agitating gear 21 and the developing frame body 12.

[Fourth Embodiment]

Figure 10:
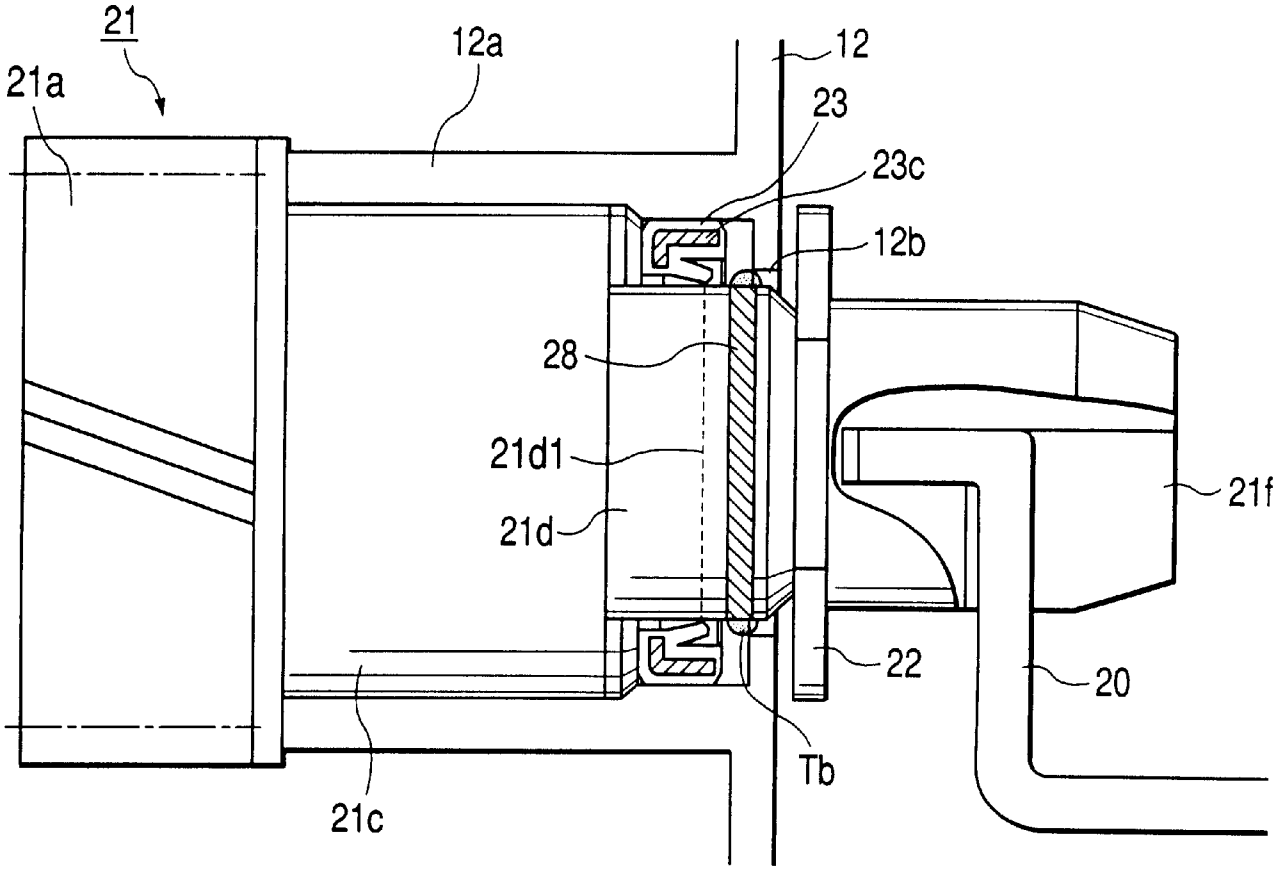
FIG. 10 is a diagram illustrating the seal configuration in a fourth embodiment.

FIG. 10 shows a seal configuration in a fourth embodiment which is in contrast to that in the third embodiment. In the fourth embodiment, a magnetic member 28 (magnetic metal, plastic magnet or the like) which is magnetized (or to be magnetized at or after a shaping stage) is inserted and shaped on a side of the toner chamber 10*a* from the lip portion and on the side of the seal member 23 from the toner chamber run-through hole 12*b* of a toner developing frame body 12.

When the magnetic toner is coagulated due to heat generated by friction with the shaft and coarse toner grains Tb are formed on the lip portion, this configuration is capable of collecting the coarse toner grains Tb on the shaft which is magnetized in the vicinity of the run-through hole 12*b* of the toner developing frame body 12, thereby preventing the grains from returning into the toner chamber 10*a*.

Figure 11:
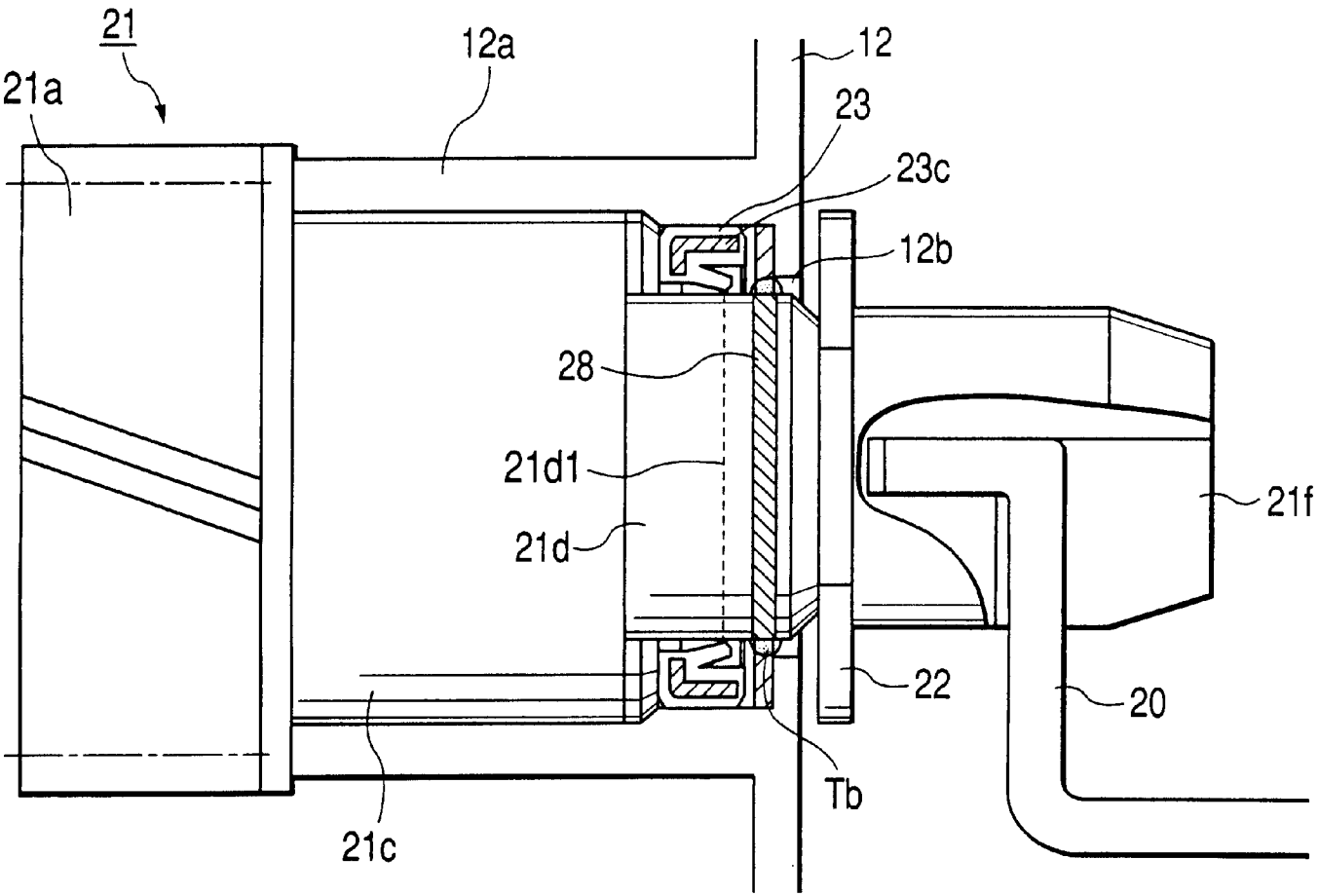
FIG. 11 is a diagram illustrating another example of the seal configuration in the fourth embodiment.

Furthermore, the effect of preventing the coarse toner grains Tb from returning into the toner chamber 10*a* can be enhanced by disposing a magnetic member 29 (or a magnetized magnetic body) on a side of the toner chamber 10*a* from the seal member 23 and inside the run-through hole 12*b* of the toner developing frame body 12 as shown in FIG. 11.

[Other Embodiments]

Though the driving force transmitting member which is in contact with the seal member is configured as the agitating gear having the helical gear in each of the embodiments as described above, a similar effect can be obtained by using a driving force transmitting member which has no helical gear but receives a force in a thrust direction, for example, with a torsion coupling, a driving-force transmitting member having a spur gear which generates no thrust force or a driving-force, transmitting member which uses a coupling free from torsion.

Though the configuration in each of the embodiments as described above is capable of preventing leakage of magnetic components when a toner is a mixture of a magnetic material and a non-magnetic material, the configuration for preventing leakage of non-magnetic components maintains a sealing property of the lip portion as it is. Leakage of the non-magnetic components out of a developer container can be prevented by preliminarily charging a magnetic powder into the magnetized portions so as to form walls Ta and Tb of the magnetic powder in the configuration in each of the embodiments as described above. Such a magnetic powder is also applicable to developer which consists of only non-magnetic toners.

Furthermore, it is possible to obtain two effects by combining the structure in the first, second or third embodiment with that in the fourth embodiment as described above.

Figure 12:
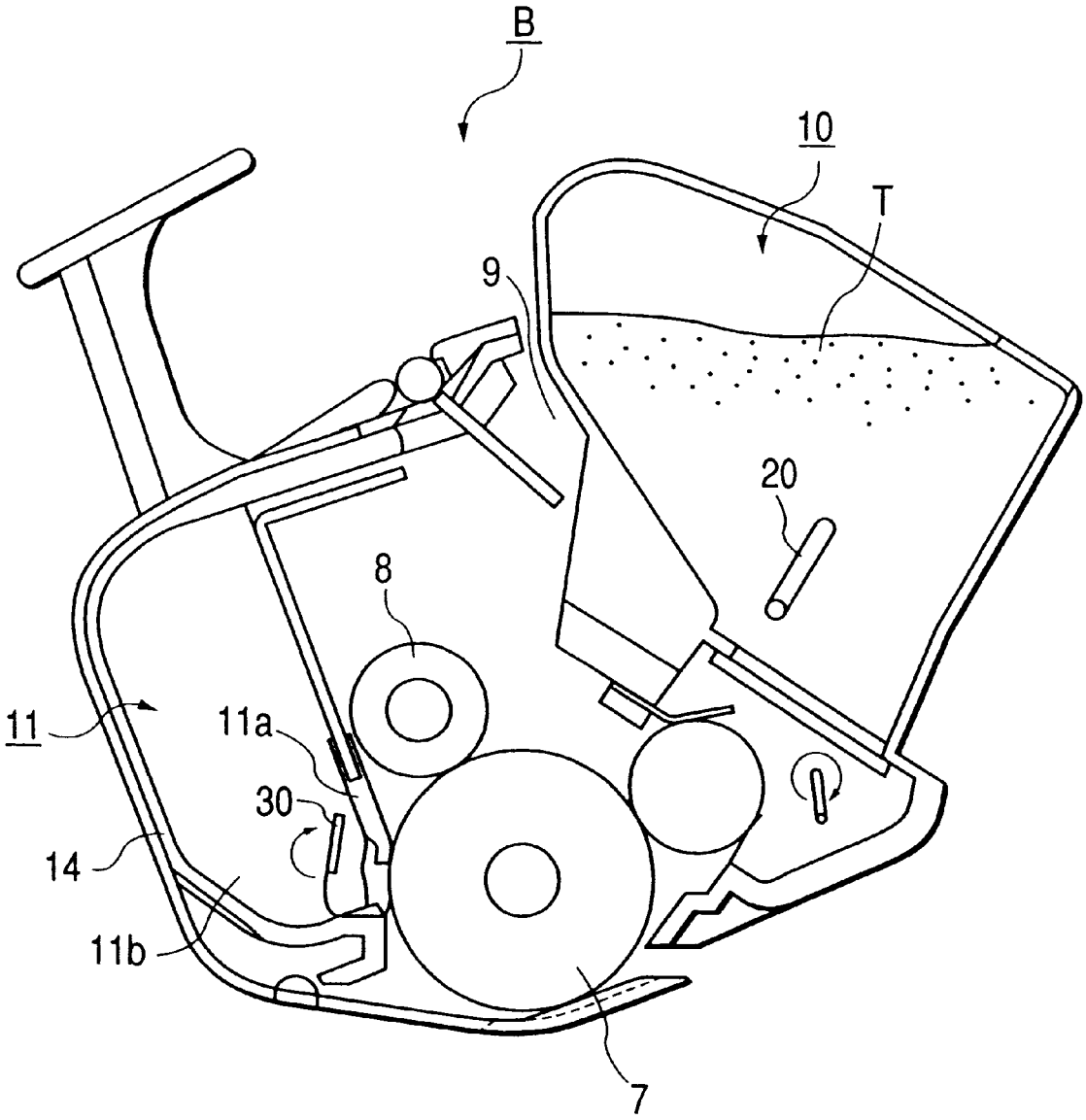
FIG. 12 is diagram illustrating an embodiment wherein the seal configuration according to the present invention is used in cleaning means.

Furthermore, though the seal configuration in the developer container has been described in each of the embodiments, the seal configuration is not limited to a developer container. A similar effect can be obtained, for example, by using a similar configuration as a seal configuration for a driving force transmitting member which transmits a rotational force to an agitating member 30 which is disposed in a waste toner container 11*b* of cleaning means so as to be rotatable in a direction indicated by an arrow as shown in FIG. 12.

What is claimed is:

1. A developer container comprising:

a main body container for containing a magnetic developer;

a rotary member rotating in contact with the magnetic developer; and a seal member for preventing the magnetic developer from leaking at an end in a direction of a rotating shaft of said rotary member, wherein said seal member includes an elastic contact portion being in contact with said rotary member for sealing the magnetic developer, and a magnetized magnetic body for sealing the magnetic developer magnetically without being in contact with said rotary member, wherein said elastic contact portion and said magnetized magnetic body are integrally formed, wherein said magnetized magnetic body is provided so as to extend from an inner side to an outer side of said elastic contact portion in the direction of said rotating shaft, and wherein an inner side portion of said elastic contact portion of said magnetized magnetic body has a force attracting the developer magnetically.

2. The developer container according to claim 1, wherein said rotary member includes a first rotary portion disposed at an inside of said main body container to contact the developer and a second rotary portion disposed at an outside of said main body container to transmit a driving force to said first rotary portion, and said seal member is disposed at the outside of said main body container, and said elastic contact portion is in contact with said second rotary portion.

3. The developer container according to claim 2, wherein said rotary member includes a second magnetized magnetic body which is located at an end in a direction of the rotating shaft and which is magnetized to magnetically seal the developer.

4. The developer container according to claim 3, wherein said second magnetized magnetic body includes a magnetized portion at the inner side of said elastic contact portion in the direction of the rotating shaft and at the outside of said main body container.

5. The developer container according to claim 1, wherein said magnetized magnetic body is a metal member which has an L shape on a section in parallel with the rotating shaft of said rotary member.

6. The developer container according to claim 1, wherein said magnetized magnetic body includes a magnetized portion at the outer side of said elastic contact portion in a direction of the rotating shaft.

7. A developer container according to claim 6, wherein said magnetized portion at the outside of said contact portion in the direction of the rotating shaft extends in a direction crossing the direction of the rotating shaft.

8. The developer container according to claim 1, wherein said rotary member includes a second magnetized magnetic body which is located at an end in a direction of the rotating shaft and which is magnetized to magnetically seal the developer.

9. The developer container according to claim 8, wherein said second magnetized magnetic body includes a magnetized portion at the outer side of said elastic contact portion in the direction of the rotating shaft.

10. The developer container according to claim 8, wherein a magnetized portion of said magnetized magnetic body is opposed to a magnetized portion of said second magnetized magnetic body.

11. The developer container according to claim 1, wherein said rotary member carries or agitates the developer.

12. The developer container according to any one of claims 1 through 11, wherein said developer container comprises, together with an image bearing member, a process cartridge which is detachably attachable to a main body of an image forming apparatus.

* * * * *

UNITED STATES PATENT AND TRADEMARK OFFICE

CERTIFICATE OF CORRECTION

PATENT NO. : 6,104,894
DATED : August 15, 2000
INVENTOR(S) : Minoru Sato, et al.

It is certified that error appears in the above-identified patent and that said Letters Patent is hereby corrected as shown below:

Title page, Item [54],
Title: "DEVELOPER CONTAINER" should read -- DEVELOPER CONTAINER INCLUDING A SEAL MEMBER FOR PREVENTING A MAGNETIC DEVELOPER FROM LEAKING AT AN END IN A DIRECTION OF A ROTATING SHAFT OF A ROTARY MEMBER ROTATING IN CONTACT WITH THE MAGNETIC DEVELOPER --.

SHEET NO. 2 OF THE DRAWINGS,
Figure 2, "23d" should read -- 23b --.

Column 1,
Line 1, "DEVELOPER CONTAINER" should read -- DEVELOPER CONTAINER INCLUDING A SEAL MEMBER FOR PREVENTING A MAGNETIC DEVELOPER FROM LEAKING AT AN END IN A DIRECTION OF A ROTATING SHAFT OF A ROTARY MEMBER ROTATING IN CONTACT WITH THE MAGNETIC DEVELOPER --;
Line 27, "a" should read -- at a --.
Line 30, "developer which" should read -- developer, which --.

Column 2,
Line 30, "made" should read -- provided --;
Line 38, "of an" should read -- an --; and
Line 39, "descriptive of" should read -- illustrating --.

Column 7,
Line 43, "driving force" should read -- driving-force --.
Line 46, "force" should read -- force, --.
Line 47, "driving-force," should read -- driving-force --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*